US006908283B2

(12) United States Patent
Soofer et al.

(10) Patent No.: US 6,908,283 B2
(45) Date of Patent: Jun. 21, 2005

(54) VEHICLE FAN SHROUD MADE INTEGRALLY WITH A COOLANT RESERVOIR

(75) Inventors: Fred Soofer, Hayward, CA (US); Kaveh Soofer, Hayward, CA (US); Kim Fong, Hayward, CA (US)

(73) Assignee: Plastikon Industries, Inc, Hayward, CA (US)

( * ) Notice: Subject to any disclaimer, the term of this patent is extended or adjusted under 35 U.S.C. 154(b) by 13 days.

(21) Appl. No.: 10/683,597

(22) Filed: Oct. 14, 2003

(65) Prior Publication Data

US 2005/0079051 A1 Apr. 14, 2005

(51) Int. Cl.[7] ..... F04D 29/52
(52) U.S. Cl. ..... 415/215.1; 415/220
(58) Field of Search ..... 415/173.1, 213.1, 415/215.1, 220; 123/41.14, 41.49, 41.48, 123/41.57; 165/122, 132; 416/189, 159 A

(56) References Cited

U.S. PATENT DOCUMENTS 3,692,004 A * 9/1972 Tangue et al. ..... 123/41.57
5,971,062 A 10/1999 Sadr et al.
6,189,492 B1 2/2001 Brown
6,523,507 B2 2/2003 Schmitz et al.

FOREIGN PATENT DOCUMENTS

JP 409088603 A * 3/1997
JP 2001317357 * 11/2001

OTHER PUBLICATIONS

Mitsubishi Pick-ups & Montero Automotive Repair Manual by Larry Warren, et al., published by Haynes Publishing Group Sparkford Nr Yeovir Somerset BA22 7JJ England (pp. 3-4, Chapter 3).

* cited by examiner

*Primary Examiner*—Ninh H. Nguyen

(57) ABSTRACT

A vehicle fan shroud made integrally with a coolant reservoir comprising a shroud unit molded from a non-transparent material with a flat flange portion and a hub portion for a radiator fan, and coolant reservoir having a shape that matches the configuration of the flange and hub, which is made from a semi-transparent material for observing the level of the coolant in the reservoir. The reservoir is made in the form of an open box and is welded to the flange portion with its open side so that the flange of the shroud closes the open part and forms a wall a wall of the reservoir. A distinguishing feature of the device of the invention is that a coolant supply nipple portion projecting from said top, a coolant supply tube located inside said coolant reservoir, and a drain pipe extended from said bottom portion are coaxial and molded integrally with the rest of the reservoir. These tubular parts are located in the corner inside the reservoir, and the coolant supply tube extending to the lever below the lower allowable level of the coolant in the reservoir but above the bottom portion of the reservoir.

20 Claims, 3 Drawing Sheets

VEHICLE FAN SHROUD MADE INTEGRALLY WITH A COOLANT RESERVOIR

FIELD OF THE INVENTION

The present invention relates to automotive equipment, in particular to fan shrouds and specifically to a fan shroud made integrally with a coolant reservoir.

BACKGROUND OF THE INVENTION

For better understanding the principle of the present invention and for introducing terminology used in the description, it would be advantageous to briefly explain the structure and operation of the radiator and the radiator cooling system.

The radiator is a device designed to dissipate the heat, which the coolant has absorbed from the engine. It is constructed to hold a large amount of a cooling liquid or coolant in tubes or passages, which provide a large area in contact with the atmosphere. As the coolant passes through the radiator during operation of the engine, it loses its heat to the airstream, which passes around the outside of the tubes. Normally, the cooling system of a vehicle has a clear plastic container, which is also known as a coolant reservoir or a coolant overflow bottle (hereinafter referred to as coolant reservoir). The coolant reservoir has marked lines that indicate the upper and lower allowable levels of the coolant in the cooling system. This coolant reservoir is connected to the coolant supply tube, which is also known as a siphon tube from the radiator and provides extra storage space for the coolant when it expands. As the engine heats up, the coolant inside it expands. Without the coolant reservoir, the coolant would flow out of the overflow tube and be lost from the cooling system.

Since a vacuum is created in the cooling system when the engine cools, the vacuum causes some of the coolant in the coolant reservoir to be sucked back into the system. The suction is carried out through the aforementioned coolant supply tube. In known radiator cooling systems the coolant supply tube from the radiator is connected to the coolant reservoir through the wall of the reservoir in its upper part or through a coolant reservoir cap which is used for adding the coolant to the cooling system when necessary. The end of the coolant supply tube inserted into the reservoir extends down to the point close or below the indicator of the lower allowable level.

The coolant reservoir may also be provided with an overflow tube located close to the top of the reservoir, e.g., in the coolant filling neck, for the overflow of the coolant when it expends to the level above this overflow tube, and with a drain tube at the bottom of the reservoir for draining the coolant from the reservoir, e.g., for cleaning the interior of the reservoir.

Because a cooling system with the coolant reservoir is virtually a closed system, the coolant can flow between the system and the coolant reservoir as it expands and contracts. This way, no coolant is lost if the system is functioning properly. The advantage of the coolant reservoir is that while the level of coolant contained in it rises and falls, the radiator is always full.

The radiator is provided with a fan surrounded by a shroud. The fan cools the cooling liquid while it circulates through the radiator's channels.

There exist a variety of arrangements for placing the coolant reservoirs in the vicinity of the radiator. Normally the coolant reservoir is attached to a vehicle body in the engine compartment and is located separately from the radiator or shroud. However, some vehicle models have the coolant reservoir removably connected to the fan shroud.

For example, U.S. Pat. No. 6,523,507 provides a fan shroud for an internal combustion engine that includes a snap-on detachable overflow bottle. The fan shroud has a fan opening and a unitary bottle mount with a deflectable bottle clip with a latch end that engages a groove in the overflow bottle. The mount includes an opposite side with an inwardly directed locking surface that engages a recess in a side face of the overflow bottle. The overflow bottle is held upright and secured to the fan shroud by snapping it into the bottle mount. A disadvantage of the design disclosed in the aforementioned patent is that it requires the use of additional snapping fasteners that can get loose under the effect of vibrations that normally occurs in the engine compartment when the vehicle is running. As a result, the coolant reservoir will be subject to vibrations that will generate a noise. Another disadvantage of the device of U.S. Pat. No. 6,523,507 is that the coolant is supplied to the coolant reservoir through a separate coolant supply tube that is inserted into the reservoir through the sealing unit. In other words, the arrangement requires the use of additional parts, such as tubes, seals, snapping elements, etc., is complicated in the manufacture, and costly in production and assembling.

The authors of U.S. Pat. No. 6,523,507 criticize the construction of fan shrouds molded integrally with the coolant overflow bottles stating that in the case of puncture or other damage of the bottle the whole shroud has to be replaced. It is understood, however, that the coolant overflow bottle located in the engine compartment and protected by the vehicle hood will never be punctured unless the vehicle is seriously damaged in an accident. If this happens, the engine has to be removed from the vehicle anyway and the shroud has to be removed as well.

U.S. Pat. No. 5,971,062 discloses a fan shroud, which is made integrally with at least one chamber for storage of a liquid or with several chambers for storage of several liquids, which may be under pressure and used with a vehicle. To facilitate handling pressure, the storage chamber includes a plurality of individual storage modules which are interconnected by a plurality of fluid flow channels so that the total storage capacity of the chamber is the sum of the storage capacity of the modules and interconnecting fluid flow channels. The modules and channels are made by bringing the front and back walls of a blow molded fan shroud into contact with each other to define there between channels and modules. The shroud comprises several such chambers and may be used to house engine coolant, power steering fluid or other fluids. In addition, the fan shroud can include chambers for storing fluids, which are not necessarily under pressure such as windshield washer fluid and the like.

A disadvantage of the arrangement shown in U.S. Pat. No. 5,971,062 is that it has a very complicated construction, which is expensive to manufacture. There is no indication in the description of the above patent to the way of checking the level of the coolant in the coolant reservoir of the device of the invention. It can be assumed, however, that since the reservoir and the shroud are blow-molded as a single piece, they are made from the same material. The shroud is normally molded from a non-transparent material and therefore the level of the coolant in the coolant reservoir is presumably checked by opening the filling cap, which is inconvenient.

U.S. Pat. No. 6,189,492 describes an automotive fan shroud that is molded integrally with two compartments, one for the coolant and another for windshield washing liquid. The compartments are closed from above by separate covers through which liquids are supplied into the respective containers. Since the compartments are molded from the same nontransparent material as the shroud, the level of the liquids in the compartments cannot be observed unless the covers are removed. Furthermore, the use of additional tubes and covers that require means for securing them in place makes the construction expensive in manufacture and assembling.

Typical engine cooling systems of vehicles are shown in a series of Automotive Repair Manuals for vehicles of various models, which are available in many automotive parts stores. For example, a cooling system for Mitshubishi Pick-ups 1983 through 1996 and Mitsubishi Montero 1983 to 1993 (shown in page 3–4, Chapter 3 of the Mitsubishi Puck-ups & Montero Automotive Repair Manual by Larry Warrenm et al. issued by Haynes Publishing Group) contains a coolant reservoir with a coolant supply tube and an overflow tube connected to the reservoir through a coolant filler cap. The reservoir is installed separately from the fan shroud. Such an arrangement entails all previously mentioned drawbacks, i.e., connection of the feeler tube and the overflow tube through seals and securing fasteners. The feeler cap has a complicated construction. The reservoir has to be attached to an internal part of the vehicle body inside the engine compartment with the use of additional fasteners which can get lose under the effect of shocks and vibrations to which a vehicle is normally subject during running. Location of the coolant reservoir separate from the shroud and the need for attachment with fasteners increases the cost of manufacturing and assembling.

OBJECTS AND SUMMARY OF THE INVENTION

It is an object of the present invention to provide a fan shroud made integrally with a coolant reservoir, which is simple in construction, inexpensive to manufacture, excludes a need for using fasteners, simplifies manufacturing and assembling procedures, reduces the number of parts required for the cooling system of the motor engine, reduces the number of manufacturing and assembling steps, and improves conditions for observation of the coolant level in the coolant reservoir.

The device of the invention comprises a substantially rectangular fan shroud produced by injection molding from a non-transparent plastic such as filled polypropylene and a transparent or semitransparent coolant reservoir thermally welded to one of the upper corners of the shroud flange on the face side of the shroud. The coolant reservoir is also produced by injection molding from such plastics as polypropylene or polyethylene. A distinguishing feature of the coolant reservoir of the invention is that it has a substantially triangular shape to match the configuration of the circular peripheral part of the hub portion of the shroud and is made in a box-like form with one side of the reservoir casing being open. This reservoir is closed by attaching it to the surface of the aforementioned flange portion of the shroud that thus forms one sidewall of the coolant reservoir. The outer periphery of the open side of the reservoir has a small weld flange for convenience of thermal welding and for forming a thermal weld seam along the outer side of the weld flange. Another distinguishing feature of the device of the invention is that the portion of the coolant supply tube, which in conventional coolant reservoirs is inserted into the reservoir via seals through the reservoir filler cap or through the upper part of the reservoir wall, a nipple portion of the coolant supply tube for connection to the hose from the radiator, and a drain pipe extended from the bottom of the reservoir, are molded integrally, e.g., as a single piece with the reservoir casing. All three tubular portions are arranged coaxially and formed in the inner corner part of the coolant reservoir on the side opposite to the aforementioned open side of the molded reservoir. The coolant supply tube portion, which is located inside the reservoir, extends downward below the lower allowable level indication mark and close to the reservoir bottom. In its upper part, the reservoir is also provided with a reservoir filler cap. The overflow pipe of the reservoir that extends outward from the reservoir can be molded integrally with the neck portion of the reservoir. A coolant reservoir cap closes the opening of the neck portion by being snugly fit and snapped on the neck portion. In order to prevent the loss of the cap, it can be connected to the reservoir by a flexible cord.

DETAILED DESCRIPTION OF THE INVENTION

Figure 1:
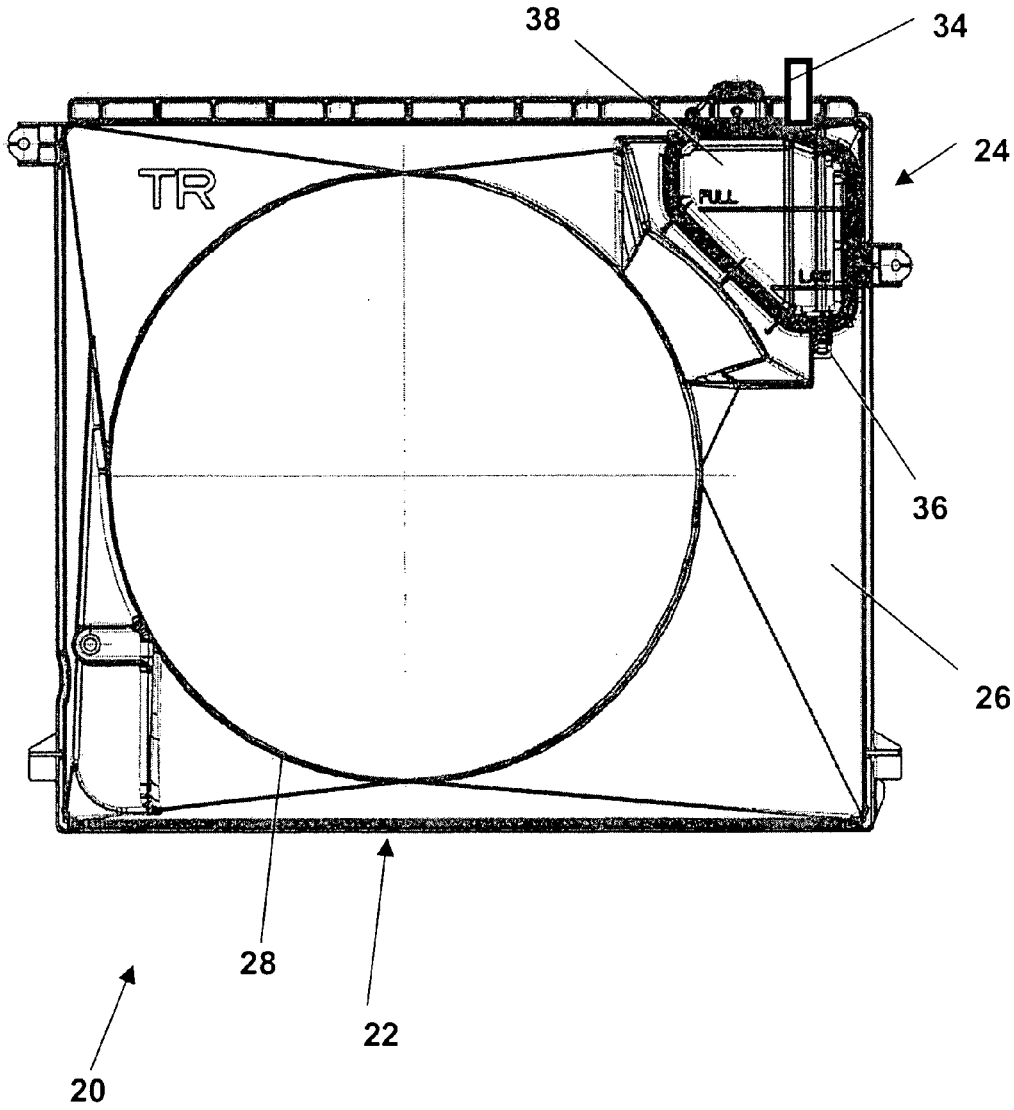
FIG. 1 is a general front view of the fan shroud made integrally with a coolant reservoir in accordance with the present invention, the view being seen from the front side of the vehicle.

The device of the invention comprises a fan shroud and a coolant reservoir assembly, which as a whole is designated by reference numeral 20 and is shown in FIG. 1, which is a front view of a fan shroud made integrally with a coolant reservoir of the present invention. The view of FIG. 1 is seen from the front side of the vehicle (not shown). As can be seen from FIG. 1, the device 20 comprises a substantially rectangular fan shroud 22 produced by injection molding from a non-transparent plastic such as filled polypropylene and a transparent or semitransparent coolant reservoir 24 thermally welded to one of the upper corners of the substantially flat shroud flange 26 on the face side of the shroud 22. The coolant reservoir 24 is also produced by injection molding from such plastics as polypropylene or polyethylene. A distinguishing feature of the coolant reservoir 24 of the invention is that it has a shape of irregular polygon to match the configuration of the circular peripheral part of the hub portion 28 of the shroud 22 and is made in a box-like configuration with one side of the reservoir casing being open.

Figure 2:
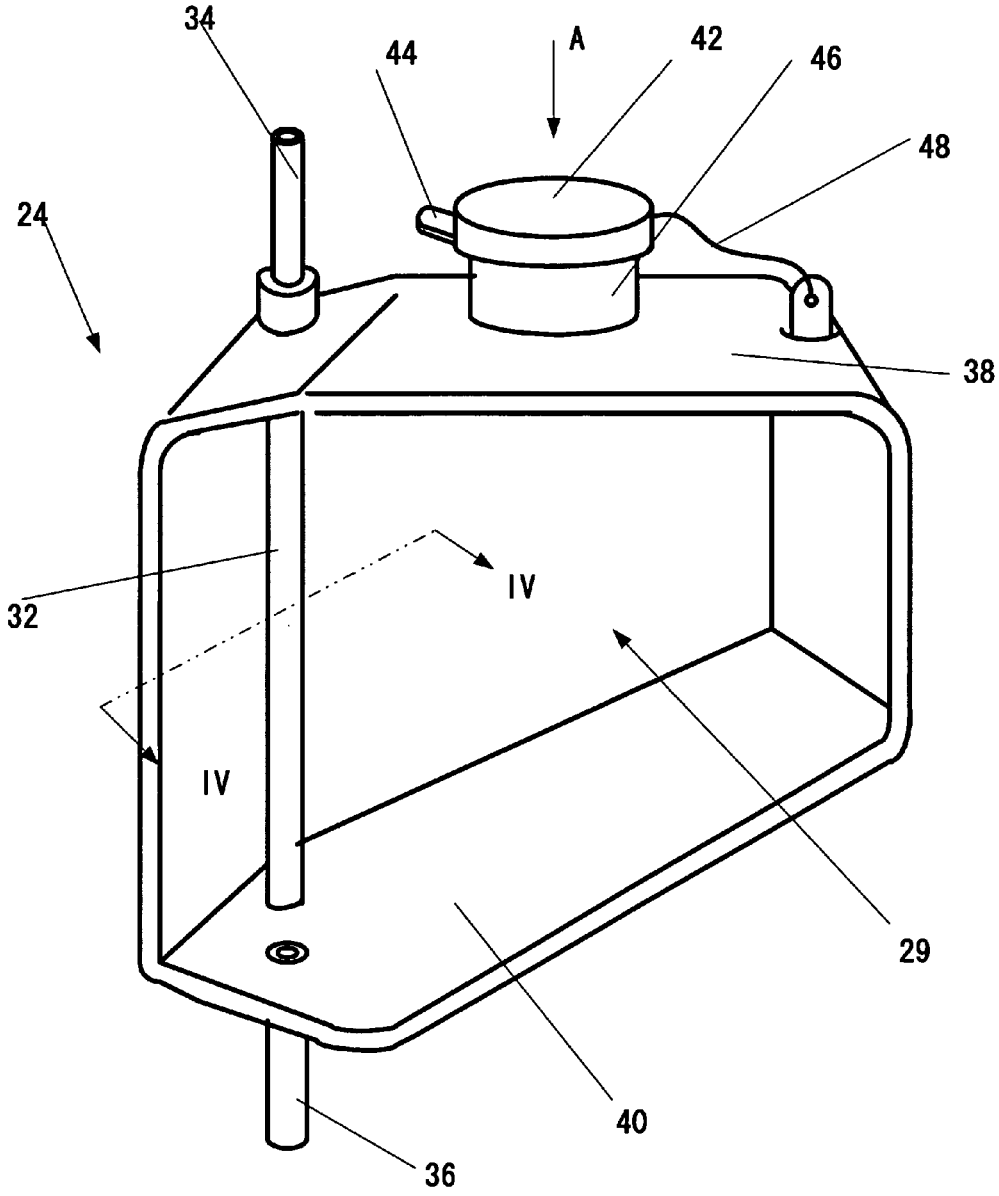
FIG. 2 is a three-dimensional view of the coolant reservoir obtained from an injection molding machine, the view being seen looking at the open side of the reservoir.

The open side 29 of the coolant reservoir is shown in FIG. 2, which is a three-dimensional view of the coolant reservoir 24 after molding in an injection molding machine, the view being seen looking at the open side of the reservoir.

Figure 3:
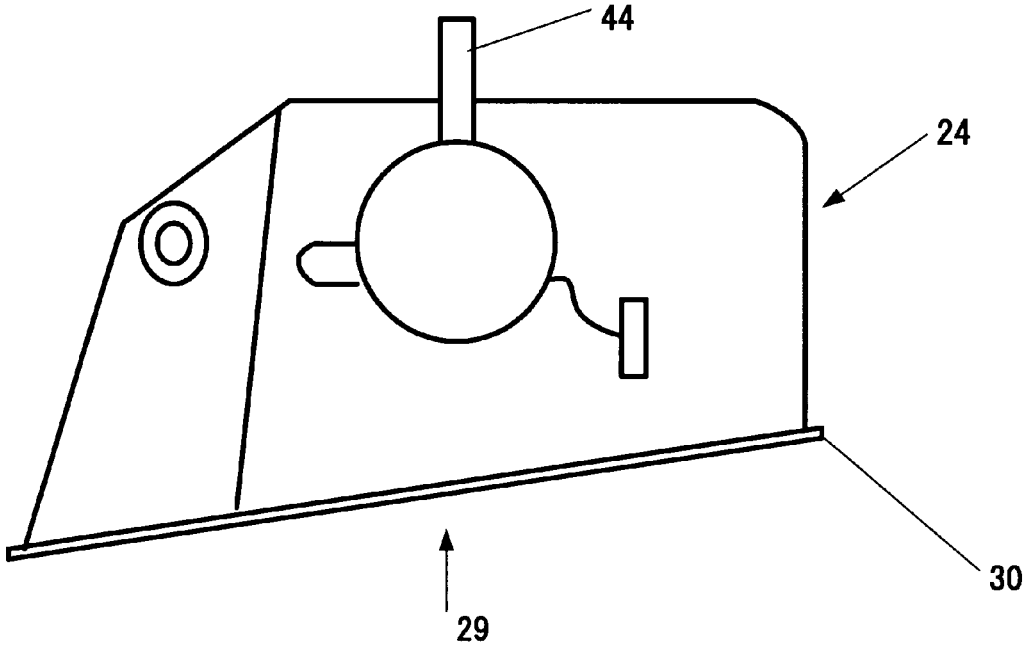
FIG. 3 is a top view of the coolant reservoir in the direction of arrow A in FIG. 2.

This reservoir 24 is closed by attaching it to the surface of the aforementioned flange portion 26 of the shroud 22 so that the surface of the flange 26 forms one sidewall of the coolant reservoir. As shown in FIG. 2, the outer periphery on the open side 29 of the reservoir has a thin weld flange 30 for convenience of attaching the coolant reservoir 24 to the surface of the flange 26 by thermal welding and for forming a thermal weld seam along the outer periphery of the weld flange 30. The welding flange is clearly seen in FIG. 3, which is a top view of the coolant reservoir in the direction of arrow A in FIG. 2.

Figure 4:
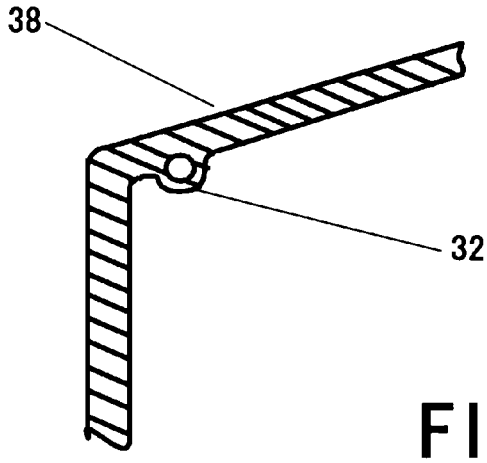
FIG. 4 is a sectional view along line IV—IV through a part of the reservoir illustrating position of the coolant supply tube.

Another distinguishing feature of the device of the invention is that the portion of the coolant supply tube 32, which in conventional coolant reservoirs is inserted into the reservoir via seals through the reservoir filler cap or through the upper part of the reservoir wall, a nipple portion 34 of the coolant supply tube for connection to the hose from the radiator (not shown), and a drain pipe 36 (FIG. 2) extended from the bottom of the reservoir 24, are molded integrally, e.g., as a single piece with the reservoir body 38. All three tubular portions are arranged coaxially and formed in the inner corner part of the coolant reservoir 24 (see FIG. 4, which is a sectional view along the line IV—IV of FIG. 2 through a part of the reservoir 24. This drawing illustrates the position of the coolant supply tube 32 in the reservoir body 38. The tubular portions 34, 32, 36 are formed on the side of the reservoir 24 opposite to the aforementioned open side 30 of the molded reservoir.

The front surface of the transparent or semitransparent coolant reservoir 24 has indication marks FULL and LOW (FIG. 1), which correspond to the maximal and minimal allowable levels of the coolant in the entire system. The level of the coolant is seen through the wall of the reservoir due to its transparency or semi-transparency.

The coolant supply tube portion 32, which is located inside the reservoir 24, extends downward below the lower allowable level indication mark LOW (FIG. 1) and close to the reservoir bottom 40 (FIG. 2).

In its upper part, the reservoir 24 is also provided with a reservoir filler cap 42 (FIG. 2). The overflow tube 44 of the reservoir 24 that extends outward from the reservoir 24 can be molded integrally with the neck portion 46 of the reservoir 24. A coolant reservoir cap 42 closes the opening of the neck portion by being snugly fit and snapped on the neck portion. In order to prevent the loss of the cap 42, it can be connected to the reservoir body 38 by a flexible cord 48.

Thus, it has been shown that the invention provides a fan shroud made integrally with a coolant reservoir, which is simple in construction, inexpensive to manufacture, excludes a need for using fasteners, simplifies manufacturing and assembling procedures, reduces the number of parts required for the cooling system of the motor engine, reduces the number of manufacturing and assembling steps, and improves conditions for observation of the coolant level in the coolant reservoir.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For examples, the reservoir may be located on the left side of the shroud as compared to the position thereof in FIG. 1. The reservoir may have the shape slightly different from the one shown in the drawings, it can be made from transparent or semitransparent plastics different from those mentioned in the specification. It can be attached to the shroud by adhesive instead of thermal welding. The shroud itself may have different shapes determined by specific model of a vehicle for which the shroud is designed.

What is claimed is:

1. A vehicle fan shroud made integrally with a coolant reservoir comprising:

a fan shroud unit formed from a single piece of material and having a substantially flat flange portion and a hub portion for a radiator fan, said hub portion having a circular periphery; and coolant reservoir for a coolant having a shape of an irregular polygon to match the configuration of a portion of said circular periphery of said hub portion, said coolant reservoir having a top portion, a bottom portion, and side portions, of which one side portion is open, said coolant reservoir being made from a substantially transparent material that allows to see the level of said coolant; and means for connecting said coolant reservoir to said substantially flat portion of said fan shroud by sealingly attaching said open side portion of said coolant reservoir so that said flat portion closes said one side of said coolant reservoir and forms a wall of said coolant reservoir.

2. The vehicle fan shroud of claim 1, wherein said means for connecting comprise a weld flange on said one side and a sealed welding seam along said weld flange.

3. The vehicle fan shroud of claim 2, wherein sealed welding seam is a thermal welding seam.

4. The vehicle fan shroud of claim 3, wherein said fan shroud portion and said coolant reservoir are parts produced by injection molding.

5. The vehicle fan shroud of claim 4, further comprising the following parts made integrally as a single piece with said coolant reservoir: a filler neck on said top portion, a coolant supply nipple portion projecting from said top, a coolant supply tube located inside said coolant reservoir, and a drain pipe extended from said bottom portion.

6. The vehicle fan shroud of claim 5, wherein said coolant supply nipple portion projecting from said top, said coolant supply tube located inside said coolant reservoir, and said drain pipe extended from said bottom portion are coaxial and are located substantially at the corner portion inside said coolant reservoir.

7. The vehicle fan shroud of claim 6, wherein one of said side portions, other than said side portion which is open, has marking items indicating the maximal allowable level of said coolant and the minimal allowable level of said coolant in said coolant reservoir, said coolant supply tube located inside said coolant reservoir extending below said minimal allowable level but above said bottom portion.

8. The vehicle fan shroud of claim 7, further comprising a filler cap for closing said filler neck.

9. The vehicle fan shroud of claim 1, further comprising the following parts made integrally as a single piece with said coolant reservoir: a filler neck on said top portion, a coolant supply nipple portion projecting from said top, a coolant supply tube located inside said coolant reservoir, and a drain pipe extended from said bottom portion.

10. The vehicle fan shroud of claim 9, wherein said coolant supply nipple portion projecting from said top, said coolant supply tube located inside said coolant reservoir, and said drain pipe extended from said bottom portion are coaxial and are located substantially at the corner portion inside said coolant reservoir.

11. The vehicle fan shroud of claim 10, wherein one of said side portions, other than said side portion which is open, has marking items indicating the maximal allowable level of said coolant and the minimal allowable level of said coolant in said coolant reservoir, said coolant supply tube located inside said coolant reservoir extending below said minimal allowable level but above said bottom portion.

12. The vehicle fan shroud of claim 11, further comprising a filler cap for closing said filler neck.

13. A vehicle fan shroud made integrally with a coolant reservoir comprising:

a fan shroud unit formed from a single piece of a non-transparent material and having a flat flange portion and a hub portion for a radiator fan, said hub portion having a circular outer periphery; and coolant reservoir for a liquid coolant having a shape of an irregular polygon to match the configuration of a portion of said circular outer periphery of said hub portion, said coolant reservoir having a top portion, a bottom portion, and side portions, of which one side portion is open, said coolant reservoir being made from a semi-transparent material that allows to see the level of said liquid coolant;

a thermal welding seam around said one side portion that sealingly attach said coolant reservoir to said flat portion of said fan shroud so that said flat portion forms a wall of said coolant reservoir;

a coolant supply nipple portion projecting from said top, a coolant supply tube located inside said coolant reservoir, and a drain pipe extended from said bottom portion which are coaxial and are all molded as a single piece with said coolant reservoir.

14. The vehicle fan shroud of claim 13, wherein said one side portion, which is open, has a periphery and weld flange along said periphery for forming said weld seam along said weld flange.

15. The vehicle fan shroud of claim 14, wherein said coolant supply nipple portion projecting from said top, said coolant supply tube located inside said coolant reservoir, and said drain pipe are located substantially at the corner portion inside said coolant reservoir.

16. The vehicle fan shroud of claim 15, further comprising a filler neck on said top portion and a filler cap removably and snugly fit onto said filler neck.

17. The vehicle fan shroud of claim 15, wherein one of said side portions, other than said side portion which is open, has marking items indicating the maximal allowable level of said coolant and the minimal allowable level of said coolant in said coolant reservoir, said coolant supply tube located inside said coolant reservoir extending below said minimal allowable level but above said bottom portion.

18. The vehicle fan shroud of claim 13, wherein one of said side portions, other than said side portion which is open, has marking items indicating the maximal allowable level of said coolant and the minimal allowable level of said coolant in said coolant reservoir, said coolant supply tube located inside said coolant reservoir extending below said minimal allowable level but above said bottom portion.

19. The vehicle fan shroud of claim 18, further comprising a filler cap for closing said filler neck.

20. The vehicle fan shroud of claim 18, further comprising a filler cap for closing said filler neck.

* * * * *